US009914318B2

(12) United States Patent
Kernig et al.

(10) Patent No.: US 9,914,318 B2
(45) Date of Patent: Mar. 13, 2018

(54) ALUMINUM STRIP FOR LITHOGRAPHIC PRINTING PLATE SUPPORTS

(75) Inventors: Bernhard Kernig, Cologne (DE); Henk-Jan Brinkman, Bonn (DE); Arve Sund, Düsseldorf (DE); Gerd Steinhoff, Dormagen (DE)

(73) Assignee: Hydro Aluminium Deutschland GmbH, Grevenbroich (DE)

( * ) Notice: Subject to any disclaimer, the term of this patent is extended or adjusted under 35 U.S.C. 154(b) by 758 days.

(21) Appl. No.: 12/090,775

(22) PCT Filed: Oct. 19, 2006

(86) PCT No.: PCT/EP2006/067573

§ 371 (c)(1),
(2), (4) Date: Sep. 10, 2008

(87) PCT Pub. No.: WO2007/045676

PCT Pub. Date: Apr. 26, 2007

(65) Prior Publication Data

US 2009/0016928 A1 Jan. 15, 2009

(30) Foreign Application Priority Data

Oct. 19, 2005 (EP) ..... 05022772

(51) Int. Cl.

| | |
|---|---|
| ***C22C 21/00*** | (2006.01) |
| ***C22F 1/04*** | (2006.01) |
| ***B41N 1/08*** | (2006.01) |
| ***C23G 1/22*** | (2006.01) |

(52) U.S. Cl.

CPC ..... *B41N 1/083* (2013.01); *C22C 21/00* (2013.01); *C22F 1/04* (2013.01); *C23G 1/22* (2013.01); *B41M 2205/12* (2013.01)

(58) Field of Classification Search

CPC . B41N 1/083; C22F 1/04; C22F 1/047; C22F 1/05; C22C 21/00; C22C 21/02; C22C 21/06; C22C 21/08

USPC ..... 420/535, 542–544, 546–548, 550–553; 148/437–440

See application file for complete search history.

(56) References Cited

U.S. PATENT DOCUMENTS

| | | | | |
|---|---|---|---|---|
| 1,743,515 | A | 1/1930 | Anderson | |
| 3,563,815 | A | 2/1971 | Meier et al. | |
| 3,721,546 | A | 3/1973 | Shiba et al. | |
| 4,003,738 | A | 1/1977 | Valdo et al. | |
| 4,435,230 | A | 3/1984 | Fujikura | |
| 4,686,083 | A | 8/1987 | Takizawa et al. | |
| 4,715,903 | A | 12/1987 | Asten et al. | |
| 4,729,939 | A | 3/1988 | Nishikawa et al. | |
| 5,104,743 | A | 4/1992 | Nishikawa et al. | 428/472.2 |
| 6,447,982 | B1 | 9/2002 | von Asten et al. | 430/278.1 |
| 6,555,247 | B2 | 4/2003 | Yamaguchi | |
| 2004/0047759 | A1 | 3/2004 | Rottwinkel et al. | |
| 2005/0013724 | A1 | 1/2005 | Ougi et al. | 420/532 |
| 2006/0254680 | A1 | 11/2006 | Rottwinkel et al. | |

FOREIGN PATENT DOCUMENTS

| | | | |
|---|---|---|---|
| DE | 19956692 | | 1/2001 |
| EP | 0164856 | | 12/1985 |
| EP | 0 211 574 | | 2/1987 |
| EP | 0 239 995 | A2 | 10/1987 |
| EP | 257957 | A1 * | 3/1988 |
| EP | 1065071 | | 1/2001 |
| EP | 1 172 228 | A2 | 1/2002 |
| EP | 1 293 579 | A2 | 3/2003 |
| EP | 1 516 744 | A2 | 3/2005 |
| EP | 1 820 866 | A1 | 8/2007 |
| EP | 1 880 861 | A1 | 1/2008 |
| EP | 2 067 871 | A1 | 6/2009 |
| JP | 60 005861 | | 1/1985 |
| JP | 62 080255 | | 4/1987 |
| JP | 01247547 | | 10/1989 |
| JP | H09-111427 | A | 4/1997 |
| JP | 11061364 | | 3/1999 |
| JP | 2000309829 | | 11/2000 |
| JP | 2002088434 | A * | 3/2002 |
| JP | 2004292862 | | 10/2004 |
| WO | 0248415 | | 6/2002 |
| WO | WO 03/023079 | A1 | 3/2003 |

OTHER PUBLICATIONS

Matsuo et al., English machine translation of JP 11-061364, Mar. 1999.*

Yamaguchi, Keitaro, English machine translation of JP 2002-088434, Mar. 2002, p. 1-10.*

Muramatsu et al., English machine translation of JP 2004-292862, Oct. 2004, p. 1-19.*

B. Kernig et al., AC Graining of Lithographic Sheet in Hydrochloric Acid, 1992, pp. 190-194, vol. No. 70, Issue No. 4, Trans. Inst. Metal Finish.

M. P. Armor et al., The Mechanism of Electrograining Aluminium Sheet in Nitric/Boric Acid Electrolyte, 1998, pp. 2155-2172, vol. No. 40, Issue No. 12, Corrosion Science, Elsevier Science Ltd., Great Britain.

J. E. Hatch, Aluminum Properties and Physcial Metallurgy, May 1984, pp. 230-231, American Society for Metals, Metals Park, Ohio.

C. Kammer, Aluminium-Taschenbuch, 1995, pp. 224-226, vol. 1, Aluminium-Verlag Düsseldorf, Germany.

C. Kammer, Aluminium-Taschenbuch, 1995, pp. 153-155, vol. 1, Aluminium-Verlag Düsseldorf, Germany.

(Continued)

*Primary Examiner* — Jessee Roe

(74) *Attorney, Agent, or Firm* — Reinhart Boerner Van Deuren P.C.

(57) ABSTRACT

An aluminum strip for lithographic printing plate supports, from which printing plate supports can be produced with an improved roughenability and at the same time improved mechanical properties, particularly after a burn-in process, is formed of an aluminum alloy which has the following proportions of alloy constituents in wt. %: 0.05%≤Mg≤0.3%, 0.008%≤Mn≤0.3%, 0.4%≤Fe≤1%, 0.05%≤Si≤0.5%, Cu≤0.04%, Ti≤0.04%, inevitable impurities individually max. 0.01%, in total max. 0.05% and remainder Al.

16 Claims, No Drawings

(56) References Cited

OTHER PUBLICATIONS

D. G. Altenpohl, Aluminium: Technology, Applications, and Environment, 5 pages, 6th edition, The Aluminum Association, Inc., Washington D.C., and The Minerals, Metals & Materials Society, Warrendale, Pennsylvania, 1998.
L. J. Cartmell et al., Hot Rolling of Sheet and Strip Aluminium and Aluminium Alloys, Jul.-Aug. 1975, pp. 313-317, Metals Technology, Germany.
Non-Final Office Action for co-pending U.S. Appl. No. 12/279,107 dated Mar. 15, 2011, 5 pages.
Response to Non-Final Office Action for co-pending U.S. Appl. No. 12/279,107 dated Jul. 14, 2011, 6 pages.
International Search Report for PCT/EP2006/067573.

* cited by examiner

ALUMINUM STRIP FOR LITHOGRAPHIC PRINTING PLATE SUPPORTS

CROSS-REFERENCE TO RELATED APPLICATIONS

This application is a National Phase Application of International Application No. PCT/EP2006/067573, filed on Oct. 19, 2006, which claims the benefit of and priority to European patent application no. EP 05 022 772.7, filed Oct. 19, 2005. The disclosure of each of the above applications is incorporated herein by reference in their entirety.

FIELD OF THE INVENTION

The invention relates to an aluminum strip for lithographic printing plate supports, consisting of an aluminum alloy, a method for producing an aluminum strip for lithographic printing plate supports and to a printing plate support.

BACKGROUND

In general, printing plate supports for lithographic printing, made of an aluminum alloy, must satisfy very stringent requirements in order to be suitable for modern printing technology. On the one hand, it must be possible to homogeneously roughen the printing plate support produced from an aluminum strip, using mechanical, chemical and electrochemical roughening methods and combinations of the described roughening methods. On the other hand, the printing plates are often subjected to a burn-in process at between 220 and 300° C. with a heating time of from 3 to 10 min after the exposure and development, in order to cure the applied photo layer. The printing plate support should lose as little strength as possible during this burn-in process, so that the printing plate supports continue to be readily handleable. The fatigue or bending cycle endurance of the printing plate supports furthermore plays a role during operation of the printing plate supports in order to be able to guarantee a long service life for the printing plate supports.

Although the previously used AlMn alloys of the type AA3003, AA3103 have a good fatigue strength compared with the likewise used printing plate supports made of an aluminum alloy of the AA1050 type, the roughening performance during the preferably used electrochemical roughening is however poor, so that an aluminum alloy of the AA1050 type is preferably used.

A further development of the aluminum alloy of the AA1050 type is known from the German laid-open specification DE 199 56 692 A1, the aluminum alloy comprising the following alloy constituents in wt. % besides aluminum:

0.3 to 0.4% Fe,
0.1 to 0.3% Mg,
0.05 to 0.25% Si,
max. 0.05% Mn,
max. 0.04% Cu.

When producing lithographic printing plate supports from an aluminum strip with the composition mentioned above, a relatively high charge carrier input is needed before achieving homogeneous roughening, in particular for the preferably employed electrochemical roughening of the aluminum strip. As a result, the roughening process is very cost-intensive. It is desirable to improve the mechanical properties of the aluminum alloy previously used to produce aluminum strips for lithographic printing plate supports.

This relates in particular to the thermal stability of the printing plate supports after a burn-in process.

Recent developments are aimed at increasing the manganese content of the aluminum alloy with the iron content remaining constant, in order to achieve a higher strength after the burn-in process. A corresponding aluminum alloy is known from the International Patent Application WO 02/48415 A1. However, increased magnesium and manganese values of the aluminum alloy also entail problems with the electrochemical roughenability.

SUMMARY OF THE INVENTION

In one aspect, the present invention provides an aluminum strip for lithographic printing plate supports, from which printing plate supports can be produced with an improved roughenability and at the same time improved mechanical properties, particularly after a burn-in process. In another aspect, the invention provides a method for producing an aluminum strip for lithographic printing plate supports, as well as corresponding printing plate supports.

An aluminum strip in accordance with an aspect of the present invention includes an aluminum alloy, that has the following proportions of alloy constituents in wt. %:

$0.05\% \leq Mg \leq 0.3\%$, $0.008\% \leq Mn \leq 0.3\%$, $0.4\% \leq Fe \leq 1\%$, $0.05\% \leq Si \leq 0.5\%$, $Cu \leq 0.04\%$, $Ti \leq 0.04\%$, inevitable impurities individually max. 0.01%, in total max. 0.05% and remainder Al.

It has surprisingly been found that despite the high Fe content, the aluminum strip according to the invention on the one hand has very good properties in respect of electrochemically roughening the strip and on the other hand improved mechanical properties, in particular after carrying out a burn-in process. This is all the more surprising since the opinion in the specialist field was previously that there should only be an Fe content of at most 0.4 wt. % in an aluminum strip for lithographic printing plate supports, so as to avoid causing nonuniform roughening of the strip owing to coarse precipitate phases in the casting, which are preferably attacked during the electrochemical roughening. The precipitation of coarse phases in the casting may not occur for the aluminum strip according to the invention since a uniformly roughened structure is achieved by the electrochemical roughening. The Mg content of from 0.05 wt. % to 0.3 wt. % in the aluminum strip according to the invention may provide recrystallisation of the aluminum alloy already in the hot strip, which leads to a globulitic grain structure with small grain diameters. This results in a reduction of striation effects during the electrochemical roughening. At the same time, the Mg content in the aluminum alloy increases the roughening rate in an electrochemical roughening method, although with an Mg content of more than 0.3 wt. % the accelerated etching attack can lead to an inhomogeneously roughened structure and the roughening process becomes problematic.

In conjunction with the relatively high Fe contents of from 0.4 to 1.0 wt. %, the Mn content of from 0.008 wt. % to 0.3 wt. % leads to an improvement in the thermal stability of the aluminum alloy, so that the strength of printing plate supports produced from the aluminum alloy according to the invention after a burn-in process is increased. In combination with the high Fe content, the addition of manganese simultaneously leads to increased reactivity in the electrochemical roughening processes, but also in the pickling processes usually carried out before the electrochemical roughening. As a result, a lower charge carrier input can be utilized, for example in order to achieve complete roughening of an aluminum strip, so that the process times for the electrochemical roughening and therefore the production costs for printing plate supports can be reduced.

The Si content of the aluminum alloy according to the invention is from 0.05 wt. % to 0.5 wt. %. The Si content affects the appearance of electrochemically roughened printing plate supports. If the Si content is too low, then too high a number of insufficiently small pits are formed in the aluminum strip. With too large an Si content, the number of pits in the roughened aluminum strip is too small and the distribution is inhomogeneous.

The Cu content of the aluminum alloy according to the invention is restricted to at most 0.04 wt. % in order to avoid extremely inhomogeneous structures during the roughening. This also applies for the proportions of titanium usually entering the melt of the aluminum alloy via the grain refining materials. It is therefore necessary to restrict the Ti content to at most 0.04 wt. %. Restricting the impurities of the aluminum alloy to individually at most 0.01 wt. % and in total at most 0.05 wt. % leads to further stabilisation of the properties of the aluminum strip for lithographic printing plate supports, particularly in respect of manufacturing tolerances of the composition of the aluminum alloy and its process properties. The aluminum strip is therefore highly suitable for producing lithographic printing plate supports since besides very good roughening properties, at the same time it provides very good mechanical properties, particularly after carrying out burn-in processes.

A further reduction of the charge carrier input necessary for achieving a homogeneously roughened surface is achieved, according to an advantageous configuration of the aluminum alloy, when the ratio of the proportions of the alloy constituents Fe/Mn is from 2 to 15, preferably from 3 to 8. The reason resides in the increased number of specific Fe- and Mn-containing precipitates which, besides the mechanical and thermal properties, also positively affects the reactivity when roughening the aluminum alloy.

When the aluminum strip has an Mn content in wt. % of $0.008\% \leq Mn \leq 0.2\%$, preferably $0.008\% \leq Mn \leq 0.1\%$, with a significant improvement in their thermal stability after a burn-in process at the same time, the susceptibility to inhomogeneity after electrochemical roughening can at the same time be reduced further.

The roughening behaviour of the aluminum strip can be improved when the aluminum alloy has a Ti content in wt. % of at most 0.01%.

The thermal stability of the aluminum strip can be improved further in respect of the strength values after a burn-in process when the ratio of the proportions of the alloy constituents Fe/Si is at least 2.

In order to improve the handleability of the printing plate supports produced from an aluminum strip, according to an advantageous embodiment, the aluminum strip has a yield point Rp0.2 of at least 180 MPa and a tensile strength Rm of at least 190 MPa in the rolling direction and/or a yield point Rp0.2 of at least 190 MPa and a tensile strength Rm of at least 200 MPa transversely to the rolling direction at room temperature.

If the aluminum strip after a heat treatment at 240° C. for 10 min. has a yield point Rp0.2 of at least 140 MPa and a tensile strength Rm of at least 150 MPa transversely to or in the rolling direction, then the aluminum strip is suitable for lithographic printing plate supports for particularly large printing runs, since these are intended to lose as little strength as possible after the burn-in process.

The aluminum strip is further improved according to a further configuration when the bending cycle endurance of the aluminum strip in the rolling direction is more than 3000 bending cycles, preferably more than 3200 bending cycles in the rolling direction. The aluminum strip according to the invention achieves the said number of bending cycles in the rolling direction in the mill-hard state and therefore significantly surpasses conventional aluminum strips in the mill-hard state. The bending cycle endurance was measured by taking samples with a length of 100 mm and a width of 20 mm from the aluminum strip, with the longitudinal axis of the samples corresponding to the rolling direction. The samples were then subjected to alternating flexion by a machine over a radius of 30 mm and the number of bends until fracture was determined. The number of bends is a measure of the stability of a printing plate support manufactured from the aluminum strip during the printing process. In the present case, the number of bending cycles was determined statistically from 12 samples. The aluminum strip therefore makes it possible to manufacture printing plate supports with a particularly long service life.

A further extended service life of printing plate supports produced from the aluminum strip is achieved when the bending cycle endurance of the aluminum strip after a heat treatment at 240° C. for 10 min. in the rolling direction is more than 3300 bending cycles, preferably more than 3400 bending cycles in the rolling direction. A possible reason for the increase in the bending cycles is on the one hand in the softening of the aluminum strip during the burn-in process and also on the other hand is the thermal stability of the aluminum strip.

An electrochemical roughening process of the aluminum strip, which is usually carried out for producing printing plate supports, is improved when the aluminum strip has a surface comprising fine globulitic grains with more than 250 grains per $mm^2$, preferably more than 350 grains per $mm^2$. A fine-grained structure with the specified grain density leads to a more homogeneous appearance in the roughened or coated state. This accelerates the roughening process overall. The grain structure may, for example, be achieved by the production method by rolling factors specially adjusted after intermediate annealing during cold rolling to final thickness.

According to another embodiment of the invention the aluminum strip is utilized for producing printing plate supports.

According to another embodiment, the invention is directed to a method for producing an aluminum strip, in that a rolling ingot of an aluminum alloy having the following alloy constituents in wt. %:

$$0.05\% \leq Mg \leq 0.3\%,$$

$$0.008\% \leq Mn \leq 0.3\%,$$

-continued $0.4\% \leq Fe \leq 1\%$, $0.05\% \leq Si \leq 0.5\%$, $Cu \leq 0.04\%$, $Ti \leq 0.04\%$, inevitable impurities individually max. 0.01%, in total max. 0.05% and remainder Al, is cast continuously or in batches.

The rolling ingot is optionally preheated or homogenised before hot rolling, the rolling ingot is hot-rolled to form a hot strip and the hot strip is cold-rolled to final thickness with or without intermediate annealing. In this case, after casting, the casting skin of the rolling ingot is generally milled off in order to improve the purity and uniformity of the aluminum strip before the hot and cold forming, and the final rolling is carried out with finely ground steel rolls. A heat pretreatment or homogenisation may preferably take place at temperatures of from 380° C. to 600° C. before the hot rolling. Furthermore, the hot strip final temperature is preferably between 280 and 370° C.

A state optimized for processing the aluminum strip to form printing plate supports and their use is achieved according to another configuration of the method according to the invention when at least one intermediate anneal is carried out during the cold rolling and the rolling factor to final thickness is between 65% and 85% after the intermediate anneal. This sets up an optimized state between soft-annealed and mill-hard so that the aluminum strip on the one hand has sufficient strength values, after a burn-in process. On the other hand, a fine-grained surface can be provided, so that a more homogeneous appearance is ensured after the roughening.

The final thickness of the aluminum strip is preferably from 0.15 mm to 0.5 mm, in particular from 0.15 mm to 0.35 mm. In the case of small thicknesses, with an aluminum strip produced by the method according to the invention, an aluminum strip optimized for the production of printing plate supports can be provided, since it has an improved roughening behaviour together with improved thermal stability and improved strength values.

In order to produce an aluminum strip for lithographic printing plate supports, the rolled aluminum strip is subjected to degreasing with an alkaline or acidic medium after the rolling and the degreased aluminum strip is electrochemically roughened. The roughening of the aluminum strip is preferably carried out in baths of nitric acid $HNO_3$ or hydrochloric acid HCl. Furthermore, the electrochemical roughening may also be carried out in mixed acid solutions.

In order to prepare the rolled aluminum strip optimally for the subsequent electrochemical roughening process, thorough degreasing is necessary. To this end, the aluminum strip is preferably degreased with a degreasing medium which contains at least 1.5 to 3 wt. % of a composition of 5 to 40 wt. % of sodium polyphosphate, 3 to 10 wt. % of sodium gluconate, 30 to 70% of sodium carbonate and 3 to 8 wt. % of a mixture of a nonionic surfactant and an ionic surfactant. The degreasing medium ensures on the one hand virtually complete removal of possibly existing rolling oil residues. On the other hand, the slightly pickling nature of the degreasing medium dissolves the rolling oxide layer of the aluminum strip.

In another aspect, the present invention provides a printing plate support produced from an aluminum strip, which has preferably been produced by the method described above. The printing plate supports according to an embodiment of the invention have an improved service life and an improved roughening behaviour compared with conventional printing plate supports.

DETAILED DESCRIPTION

There are many embodiments and possibilities for refining and configuring the aluminum alloy, the aluminum strip and the method according to the invention for producing an aluminum strip for lithographic printing plate supports. To this end, reference is made on the one hand to an aluminum alloy having proportions of alloy constituents in the following wt. %: $0.05\% \leq Mg \leq 0.3\%$; $0.008\% \leq Mn \leq 0.3\%$; $0.4\% \leq Fe \leq 1\%$; $0.05\% \leq Si \leq 0.5\%$; $Cu \leq 0.04\%$; $Ti \leq 0.04\%$; inevitable impurities individually max. 0.01%, in total max. 0.05% and remainder Al, and on the other hand to the following description of exemplary embodiments.

Table 1 represents the studied aluminum alloys and their compositions in respect of the alloy constituents Fe, Mn and Mg. The aluminum alloys V402 and V404 have a composition corresponding to the prior art and are therefore used as comparative alloys. The rolling ingots including the various aluminum alloys specified in Table 1 were hot-rolled to a thickness of 4.0 mm, after removing the casting skin and preheating, then subjected to cold rolling to a final thickness of 0.3 mm and optionally intermediately annealed between two cold rolling runs. Aluminum strips were respectively produced in the HI 8 state with an intermediate anneal at 2.2 mm and in the H19 state without an intermediate anneal.

TABLE 1

| Melt | Fe | Mn | Mg | Si | |
|---|---|---|---|---|---|
| V402 | 0.36 | 0.008 | 0.22 | 0.10 | Prior art |
| V403 | 0.48 | 0.008 | 0.22 | 0.10 | Applicant's embodiment |
| V404 | 0.35 | 0.010 | 0.22 | 0.10 | Prior art |
| V405 | 0.52 | 0.010 | 0.22 | 0.10 | Applicant's embodiment |
| V407 | 0.4 | 0.050 | 0.21 | 0.10 | Applicant's embodiment |
| V408 | 0.54 | 0.050 | 0.2 | 0.10 | Applicant's embodiment |
| V409 | 0.43 | 0.095 | 0.22 | 0.10 | Applicant's embodiment |
| V410 | 0.59 | 0.095 | 0.2 | 0.10 | Applicant's embodiment |

The aluminum strips produced with intermediate annealing and those produced without intermediate annealing were subjected to tensile tests according to DIN EN 10002, which were carried out at room temperature and after a burn-in process at 240° C. for 10 min. The results of the tensile tests are represented on the one hand for aluminum strips with intermediate annealing in Table 2 (Test No. 1 to 8) and on the other hand without intermediate annealing in Table 3 (Test No. 9 to 16). For the aluminum strips produced with intermediate annealing, it is found by comparison between the comparative aluminum strips of Tests No. 1 and 3 that the yield point Rp0.2 and the tensile strength of the aluminum strips increase with increasing iron and manganese contents. The thermal stability, i.e. the yield point Rp0.2 and the tensile strength Rm after a burn-in process, do not change. In contrast to this, the aluminum strips according to the invention show in comparison with the comparative alloy strips of Tests No. 9 and 11 on the one hand an increase in the yield point Rp0.2 and the tensile strength Rm and on the other hand likewise increased values for the yield point Rp0.2 and the tensile strength Rm after a burn-in process at 240° C. for 10 min.

The increase in the thermal stability due to the combination of high Fe content and increased Mn contents are shown in Tests No. 13 to 16. Although with virtually identical Fe contents Tests No. 13 and 14 already show an increased yield point Rp0.2 after a thermal burn-in process compared with conventional aluminum strips, the yield point Rp0.2 nevertheless rises further with an increasing Mn content as shown by Tests 15 and 16.

Surprisingly, the increase in the thermal stability after a burn-in process is particularly impressive especially with high Fe and Mn values (cf. Test No. 16) in the H19 state. The values for the yield point Rp0.2 increase from below 140 MPa to about 150 MPa and those for the tensile strength from 140 MPa to about 160 MPa.

TABLE 2

| | | | Room temperature | | 240° C./10 min | | Δ | |
|---|---|---|---|---|---|---|---|---|
| | No. | Melt | $Rp_{0.2}$ (MPa) | Rm (MPa) | $Rp_{0.2}$ (MPa) | Rm (MPa) | $Rp_{0.2}$ (MPa) | Rm (MPa) |
| Prior art | 1 | V402 | 192 | 199 | 145 | 158 | 47 | 41 |
| Applicant's embodiment | 2 | V403 | 197 | 204 | 147 | 158 | 50 | 46 |
| Prior art | 3 | V404 | 193 | 199 | 144 | 157 | 49 | 42 |
| Applicant's embodiment | 4 | V405 | 198 | 205 | 148 | 159 | 50 | 46 |
| Applicant's embodiment | 5 | V407 | 196 | 203 | 145 | 156 | 51 | 47 |
| Applicant's embodiment | 6 | V408 | 200 | 208 | 147 | 156 | 53 | 52 |
| Applicant's embodiment | 7 | V409 | 197 | 203 | 144 | 156 | 53 | 47 |
| Applicant's embodiment | 8 | V410 | 203 | 211 | 148 | 157 | 55 | 54 |

TABLE 3

| | | | Room temperature | | 240° C./10 min | | Δ | |
|---|---|---|---|---|---|---|---|---|
| | No. | Melt | $Rp_{0.2}$ (MPa) | Rm (MPa) | $Rp_{0.2}$ (MPa) | Rm (MPa) | $Rp_{0.2}$ (MPa) | Rm (MPa) |
| Prior art | 9 | V402 | 194 | 208 | 137 | 140 | 57 | 68 |
| Applicant's embodiment | 10 | V403 | 196 | 213 | 140 | 151 | 56 | 62 |
| Prior art | 11 | V404 | 192 | 206 | 136 | 149 | 56 | 57 |
| Applicant's embodiment | 12 | V405 | 197 | 214 | 140 | 151 | 57 | 63 |
| Applicant's embodiment | 13 | V407 | 197 | 212 | 143 | 155 | 54 | 57 |
| Applicant's embodiment | 14 | V408 | 200 | 217 | 145 | 155 | 56 | 62 |
| Applicant's embodiment | 15 | V409 | 198 | 211 | 150 | 163 | 48 | 48 |
| Applicant's embodiment | 16 | V410 | 203 | 221 | 149 | 160 | 54 | 61 |

Table 4 represents the results for the roughening behaviour of the aluminum alloys according to embodiments the invention compared with the previously used aluminum alloys of Tests No. 17 and 19. The results of the roughening tests of the aluminum strips produced with and without intermediate annealing have been compiled qualitatively in the table. The roughening was carried out in an HNO3 bath, which reacts more sensitively to striations or inhomogeneities which may occur. The roughening behaviour of the melts preferably used in the past, from Tests No. 17 and 19, were used as a reference for the level of the charge carrier input and were evaluated as satisfactory "o". A reduced charge carrier input to achieve surface-wide roughening was evaluated with a "+". A "+" therefore denotes a reduction of the charge carrier input, a "++" denotes a stronger reduction and a "+++" denotes a substantial reduction of the charge carrier input. The homogeneity of the roughening was furthermore evaluated. Here again, the aluminum alloys with Test No. 17 and 19 were used as a reference and evaluated as satisfactory "o". In the range of the Fe/Mn ratio from 2 to 15 and 3 to 8, respectively, the values of the charge carrier input for homogeneous roughening of the aluminum strip are reduced. In the tests under laboratory conditions, a reduction of the charge carrier input by up to 25% below the usual charge carrier input was achieved with the aluminum alloys according to embodiments of the invention. At the same time a further improved homogeneity of the roughening is found, especially in Tests No. 22 and 24.

TABLE 4

| No. | Melt | Fe | Mn | Mg | Roughenability | Homogeneity of the roughening |
|---|---|---|---|---|---|---|
| 17 | V402 | 0.36 | 0.008 | 0.22 | ○ | ○ |
| 18 | V403 | 0.48 | 0.008 | 0.22 | ○/+ | ○/+ |
| 19 | V404 | 0.35 | 0.01 | 0.22 | ○ | ○ |
| 20 | V405 | 0.52 | 0.01 | 0.22 | + | ○/+ |
| 21 | V407 | 0.4 | 0.05 | 0.21 | ○/+ | + |
| 22 | V408 | 0.54 | 0.05 | 0.2 | ++ | ++ |
| 23 | V409 | 0.43 | 0.095 | 0.22 | ++ | ○/+ |
| 24 | V410 | 0.59 | 0.095 | 0.2 | +++ | +++ |

As a result, both the roughening behaviour and the homogeneity of the roughening can be improved substantially by the aluminum alloy according to the invention. Since the aluminum alloy according to the invention at the same time has good or even better mechanical properties, particularly after a burn-in process, when producing printing plate supports not only more economical but also improved products, i.e. improved printing plate supports, can be produced with a reduction in process times.

Further studies were carried out on an additional exemplary embodiment of the aluminum strip according to the invention compared with a conventional aluminum strip for lithographic printing plate supports. The alloy constituents of the aluminum alloys used are reported in Table 5.

TABLE 5

| Melt | Fe | Mn | Mg | Si | Cu | Zn | Ti | B | |
|---|---|---|---|---|---|---|---|---|---|
| V486 | 0.36 | 0.05 | 0.2 | 0.08 | 0.004 | 0.02 | 47 ppm | 8 ppm | Pr. A |
| V488 | 0.64 | 0.1 | 0.19 | 0.10 | 0.001 | 0.02 | 44 ppm | 8 ppm | Inv. |

Aluminum strips in the H118 state were likewise produced from the V486 and V488 melts, an intermediate anneal thus taking place during the cold rolling. In contrast to the previous exemplary embodiments, the rolling factor to final thickness after the intermediate anneal was restricted to 65% to 85%.

The yield point Rp0.2 and the tensile strength in the rolling direction (1) and transversely to the rolling direction (t) were measured as a function of the temperature of a burn-in process. The results are reported in Table 6.

TABLE 6

| Melt | State | $R_p0.2$ (MPa) (t) | $R_m$ (MPa) (t) | $R_p0.2$ (MPa) (I) | Rm (MPa) (I) |
|---|---|---|---|---|---|
| V486 | mill-hard | 187 | 196 | 178 | 183 |
| | 200° C./10 min | 166 | 178 | 154 | 167 |
| | 220° C./10 min | 157 | 169 | 143 | 158 |
| | 240° C./10 min | 149 | 159 | 137 | 150 |
| V488 | mill-hard | 194 | 205 | 187 | 192 |
| | 200° C./10 min | 173 | 186 | 159 | 173 |
| | 220° C./10 min | 163 | 175 | 151 | 164 |
| | 240° C./10 min | 155 | 164 | 144 | 154 |

The aluminum strip, in conjunction with the method parameters according to the invention, has an improved yield point both transversely and longitudinally to the rolling direction compared with the conventional aluminum strip, as expected.

When studying the surface grain structure of all of the aluminum strips, despite the method parameters being the same, the aluminum strip according to the invention has a significantly smaller average grain diameter of 54 μm and the number of globulitic grains on the surface is 391 per $mm^2$. In this context, the conventional strip achieves only a grain number of 123 per $mm^2$ with an average grain diameter of 95 μm. The grain stretching was similar for both aluminum strips, i.e. 2.3 (Al strip according to the invention) and 2.9 (conventional Al strip). The substantially finer grain structure of the aluminum strip according to the invention leads to a significantly more homogeneous appearance after roughening in electrochemical roughening.

In the subsequently performed measurements of the bending cycle endurance in the rolling direction, the exemplary embodiment of the aluminum strip according to the invention produced from the V488 melt achieved 3390 bending cycles in the mill-hard state after burning-in at 240° C./10 min and even 4060 bending cycles after burning-in at 260° C./4 min. For comparison, the conventional aluminum strip produced from the V486 melt achieved only 2830 bending cycles when mill-hard and 2950 and 3250 bending cycles, respectively, after burn-in processes at 240° C./10 min. and 260° C./4 min. The rise in the number of bending cycles is at maximum about 25% compared with the conventional aluminum strip. Overall, a significant increase in the service lives of the printing plate supports produced from the aluminum strip according to the invention is thus possible.

The invention claimed is:

1. Aluminum strip for lithographic printing plate supports, consisting of an aluminum alloy, wherein the aluminum alloy has the following proportions of alloy constituents in wt. %:

$$0.05\% \leq Mg \leq 0.3\%,$$

$$0.05375\% \leq Mn \leq 0.3\%,$$

$$0.43\% \leq Fe \leq 1\%,$$

$$0.05\% \leq Si \leq 0.5\%,$$

$$Cu \leq 0.04\%,$$

$$0\% < Ti \leq 0.04\%,$$

inevitable impurities individually max. 0.01%, in total max. 0.05% and remainder Al, and wherein at room temperature the aluminium strip has a yield point Rp0.2 at least 180 Mpa and a tensile strength Rm of at least 190 Mpa in the rolling direction and/or room temperature a yield point Rp0.2 of at least 190 Mpa and a tensile strength Rm of at least 200 Mpa transversely to the rolling direction.

2. Aluminum strip according to claim 1, wherein the aluminum alloy has a Ti content in wt. % of at most 0.01%.

3. Aluminum strip according to claim 1, wherein the aluminum strip after a heat treatment at 240° C. for 10 min. has a yield point Rp0.2 of at least 140 MPa and a tensile strength of at least 150 MPa transversely to or in the rolling direction.

4. Aluminum strip according to claim 1, wherein the bending cycle endurance of the aluminum strip in the rolling direction is more than 3000 bending cycles, in the rolling direction over a radius of 30 mm.

5. Aluminum strip according to claim 1, wherein the bending cycle endurance of the aluminum strip after a heat treatment at 240° C. for 10 min. in the rolling direction is more than 3300 bending cycles, in the rolling direction.

6. Aluminum strip according to claim 1, wherein the aluminum strip has a surface comprising fine globulitic grains with more than 250 grains per mm2.

7. The aluminium strip according to claim 1, wherein the ration of the proportions of the alloy constituents Fe/Mn is from 3 to 8.

8. The aluminium strip according to claim 1, wherein aluminium alloy has an Mn content in wt. % of 0.05375%≤Mn≤0.1%.

9. The aluminium strip according to claim 1, wherein the ratio of the proportions of the ally constituents Fe/Si is at least 2.

10. The aluminium strip according to claim 1, wherein the sum of Mg and Mn contents is more than 0.3 wt. % and less than 0.6 wt. %.

11. A lithographic printing plate support comprising an aluminum strip consisting of an aluminum alloy wherein, the aluminum alloy has the following proportions of alloy constituents in wt. %:

$0.05\% \leq Mg \leq 0.3\%$, $0.05375\% \leq Mn \leq 0.3\%$, $0.43\% \leq Fe \leq 1\%$, $0.05\% \leq Si \leq 0.5\%$, $Cu \leq 0.04\%$, $0\% < Ti \leq 0.04\%$, inevitable impurities individually max. 0.01%, in total max. 0.05% and remainder Al;

hot-rolling the ingot to form a hot strip; and cold-rolling the hot strip to a final thickness with or without intermediate anneals, and wherein at room temperature the aluminium strip has a yield point Rp0.2 at least 180 Mpa and a tensile strength Rm of at least 190 Mpa in the rolling direction and/or room temperature a yield point Rp0.2 of at least 190 Mpa and a tensile strength Rm of at least 200 Mpa transversely to the rolling direction.

12. Method for producing an aluminum strip for lithographic printing plate supports, comprising casting an ingot of an aluminum alloy having the following alloy constituents in wt. %:

$0.05\% \leq Mg \leq 0.3\%$, $0.05375\% \leq Mn \leq 0.3\%$, $0.43\% \leq Fe \leq 1\%$, $0.05\% \leq Si \leq 0.5\%$, $Cu \leq 0.04\%$, $0\% < Ti \leq 0.04\%$, inevitable impurities individually max. 0.01%, in total max. 0.05% and remainder Al;

hot-rolling the ingot to form a hot strip; and cold-rolling the hot strip to a final thickness with or without intermediate anneals, and wherein at room temperature the aluminium strip has a yield point Rp0.2 at least 180 Mpa and a tensile strength Rm of at least 190 Mpa in the rolling direction and/or room temperature a yield point Rp0.2 of at least 190 Mpa and a tensile strength Rm of at least 200 Mpa transversely to the rolling direction.

13. Method according to claim 12, wherein at least one intermediate anneal is carried out during the cold rolling and the rolling factor to final thickness is between 65% and 85% after the intermediate anneal.

14. Method according to claim 12, wherein the final thickness of the aluminum strip is from 0.15 mm to 0.5 mm.

15. Method according to claim 12 further comprising casting the ingot continuously or in batches.

16. Method according to claim 12 further comprising preheating or homogenising the ingot before hot-rolling.

* * * * *